US008464897B2

(12) United States Patent
Bloom

(10) Patent No.: US 8,464,897 B2
(45) Date of Patent: Jun. 18, 2013

(54) ATTACHABLE, REPLACEABLE SKID PAD FOR RECEPTACLE

(75) Inventor: Ted E. Bloom, Warren, OH (US)

(73) Assignee: Incredible Plastics, Inc., Warren, OH (US)

( * ) Notice: Subject to any disclaimer, the term of this patent is extended or adjusted under 35 U.S.C. 154(b) by 221 days.

(21) Appl. No.: 12/965,418

(22) Filed: Dec. 10, 2010

(65) Prior Publication Data

US 2012/0145730 A1 Jun. 14, 2012

(51) Int. Cl.
*B65D 25/24* (2006.01)
*B65D 90/12* (2006.01)
*B65D 1/40* (2006.01)

(52) U.S. Cl.
USPC ..... 220/729; 220/630; 220/632; 220/732; 220/908

(58) Field of Classification Search
USPC ..... 220/630, 632, 729, 732, 908; D34/5
See application file for complete search history.

(56) References Cited

U.S. PATENT DOCUMENTS 5,251,780 A * 10/1993 Lee ..... 220/630

* cited by examiner

*Primary Examiner* — Anthony Stashick
*Assistant Examiner* — Madison L Poos
(74) *Attorney, Agent, or Firm* — Turocy & Watson, LLP; Francis L. Dunn, Jr.

(57) ABSTRACT

Systems, methods, and devices that facilitate producing and using an attachable, replaceable skid pad on a receptacle are presented. A skid pad can be created using a desired material(s), wherein the skid pad can be desirably shaped to conform with a bottom edge of a receptacle so that the skid pad can be desirably attached to the bottom edge of the receptacle and so that the outer surface of the skid pad can be desirably used to pull or drag the receptacle across a wide variety of surfaces, including soft or malleable surfaces. The skid pad can be attached to the receptacle using screws to attach it to, using a desired adhesive to attach it to, or by being snapped onto, a bottom region of the receptacle. The skid pad is removable from the receptacle when desired (e.g., when worn) and can be replaced with another skid pad.

20 Claims, 11 Drawing Sheets

ATTACHABLE, REPLACEABLE SKID PAD FOR RECEPTACLE

TECHNICAL FIELD

The subject specification generally relates to skid pads, and, more particularly, a skid plate that is attachable to a receptacle, such as a waste receptacle, and replaceable when desired.

BACKGROUND

Often, when a person (e.g., maintenance person, construction worker, landscaper, cleaning person, homemaker, etc.) is disposing of waste, the person will place the waste into a waste receptacle (e.g., garbage or trash can). Depending on the type of waste, and the size of the receptacle, the weight of the receptacle with the waste therein can become relatively heavy, thereby making the receptacle difficult or impossible to pick up or carry. To facilitate enabling a person to move a heavy receptacle, some waste receptacles are equipped with wheels to allow the person to pull or push the heavy receptacle across a surface. While having wheels on a receptacle can be useful in certain instances, there are some drawbacks with using wheels on receptacles. For example, wheels can be ineffective on certain surfaces, such as gravel, lawns (particularly lawns with wet or muddy ground), muddy areas, sand, etc., as the wheels can sink in and become stuck or wedged in such surfaces or can at least make it difficult to move the receptacle across such surfaces, particularly when the receptacle is loaded with waste. Also, wheels on the receptacle can break off or the wheel axle can be bent thereby making the wheels completely or at least partially ineffective. As a result, using wheels on waste receptacles can be undesirable in many instances.

Other types of receptacles can have no wheels. Such type of receptacle typically has defined edges on its bottom, which can make it difficult to drag across many types of surfaces, such as gravel, lawns (particularly lawns with wet or muddy ground), muddy areas, sand, etc., particularly when the receptacle is heavy due to the amount of waste contained therein, as the defined edge of the bottom of the receptacle can become wedged in the soft or malleable surface. Also, dragging the receptacle across certain types of surfaces, such as gravel, concrete, or other rougher surfaces, can cause the defined edge of the receptacle bottom to become marred, wear away, and/or develop a hole in the receptacle.

Today, there is no way to effectively use a receptacle over a wide variety of surfaces, particularly soft or malleable surfaces. Also, currently there is no effective way to maintain the integrity of the receptacle when using a receptacle over a wide variety of surfaces.

SUMMARY

The following presents a simplified summary of the subject specification in order to provide a basic understanding of some aspects of the subject specification. This summary is not an extensive overview of the subject specification. It is intended to neither identify key or critical elements of the subject specification nor delineate the scope of the subject specification. Its sole purpose is to present some concepts of the subject specification in a simplified form as a prelude to the more detailed description that is presented later.

The subject specification provides systems, methods, and devices that can facilitate producing an attachable, replaceable skid pad (e.g., skid plate) and utilizing the skid pad on a receptacle (e.g., waste receptacle or container) are presented. In an aspect, a skid pad can be created using a desired material(s) (e.g., polymer-based material, metal, fiberglass, wood, etc.), wherein the skid pad can be desirably shaped or contoured to conform with a bottom edge portion of a receptacle so that the skid pad can be desirably attached to the bottom edge portion of the receptacle and so that the outer surface of the skid pad can be desirably used to move, pull, or drag the receptacle across a wide variety of surfaces, including soft or malleable surfaces (e.g., gravel, lawns, concrete, polymer surface, mud, etc.). In another aspect, the skid pad can be attached to the receptacle using a desired fastener component (e.g., screws, fastening pins) to attach it to, using a desired adhesive fastener to attach it to, or by being snapped onto, a bottom region of the receptacle. In still another aspect, the skid pad can be removable from the receptacle when desired (e.g., when the skid pad is worn) and can be replaced with another skid pad.

The disclosed subject matter includes a device that can facilitate movement of a receptacle. In an aspect, the device can comprise a skid pad that is configured to be attachable to a bottom edge portion of the receptacle to facilitate the movement of the receptacle across a surface. In another aspect, the device can include one or more attachment facilitator components that are formed in the skid pad to facilitate attachment of the skid pad to the bottom edge portion of the receptacle.

The disclosed subject matter also comprises a system that can facilitate movement of receptacle across a surface. In an aspect, the system can comprise a receptacle that is formed to comprise a bottom end that is closed and a top end that is at least partially open to form a chamber in the receptacle to facilitate holding materials within the chamber. In another aspect, the system can comprise a skid pad that is configured to be attachable to a bottom edge portion of the receptacle to facilitate the movement of the receptacle across a surface.

The disclosed subject matter also includes a method that can facilitate moving a receptacle across a surface. In an aspect, the method can conclude forming a skid pad, wherein the skid pad can conform, or at least substantially conform, to a shape of at least one bottom edge portion associated with at least one side of a receptacle. In another aspect, the method can include forming at least one attachment facilitator component on the skid pad to facilitate attaching the skid pad to the receptacle.

To the accomplishment of the foregoing and related ends, the subject specification, then, comprises the features hereinafter fully described. The following description and the annexed drawings set forth in detail certain illustrative aspects of the subject specification. However, these aspects are indicative of but a few of the various ways in which the principles of the subject specification may be employed. Other aspects, advantages and novel features of the subject specification will become apparent from the following detailed description of the subject specification when considered in conjunction with the drawings.

DETAILED DESCRIPTION

Figure 1:
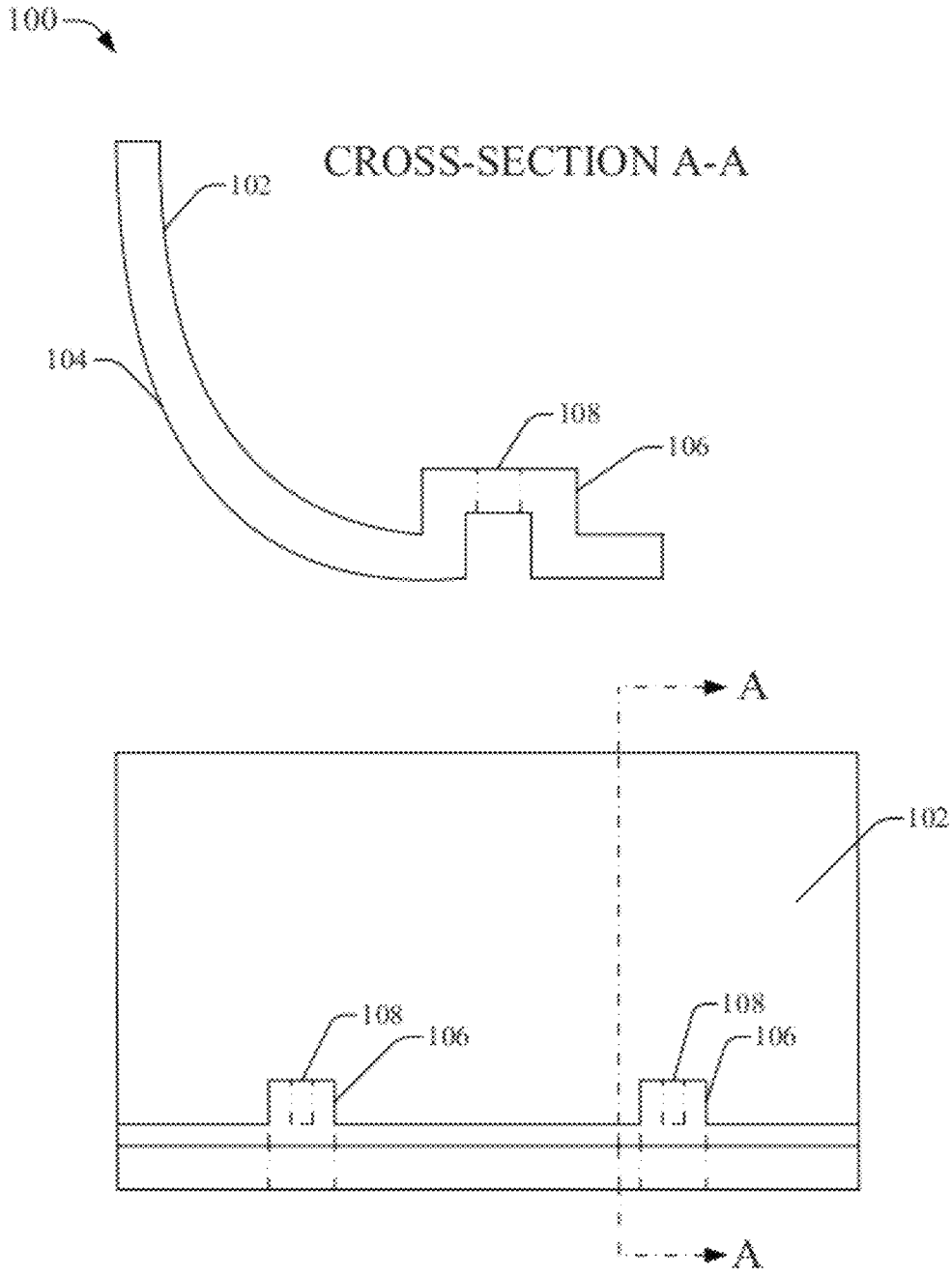
FIG. 1 is a diagram of an example skid pad that can facilitate movement of a receptacle across surfaces in accordance with an embodiment of the disclosed subject matter.

The subject specification is now described with reference to the drawings, wherein like reference numerals are used to refer to like elements throughout. In the following description, for purposes of explanation, numerous specific details are set forth in order to provide a thorough understanding of the present subject specification. It may be evident, however, that the present subject specification may be practiced without these specific details. In other instances, well-known structures and devices are shown in block diagram form in order to facilitate describing the present subject specification.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

In many instances, when a person (e.g., maintenance person, construction worker, landscaper, cleaning person, homemaker, etc.) is disposing of waste, that person will place the waste into a waste receptacle (e.g., garbage or trash can). Sometimes, the weight of the receptacle and waste therein can become relatively heavy, thereby making the receptacle difficult or impossible to pick up or carry. Some waste receptacles are equipped with wheels, which can allow the person to pull or push a heavy receptacle across a surface. However, while having wheels on a receptacle can be useful in certain instances, there are some drawbacks with using wheels on receptacles. For example, wheels can be ineffective on certain surfaces, such as gravel, lawns (e.g., lawns with wet or muddy ground), muddy areas, sand, etc., as the wheels can sink in and become stuck or wedged in such surfaces or can at least make it difficult to move the receptacle across such surfaces, particularly when the receptacle is loaded and heavy with waste. Also, wheels on the receptacle can break off or the wheel axle can be bent thereby making the wheels completely or at least partially ineffective. As a result, using wheels on waste receptacles can be undesirable in many instances. Further, other types of receptacles can employ no wheels. Such type of receptacle typically can have defined edges associated with its bottom surface, which can make it difficult to drag the receptacle across many types of surfaces, such as gravel, lawns (e.g., lawns with wet or muddy ground), sand, etc., particularly when the receptacle is heavy due to the amount of waste contained therein, as the defined edge associated with the bottom of the receptacle can become wedged in the soft or malleable surface when the receptacle is dragged across such surface. Furthermore, dragging the receptacle across certain types of surfaces, such as gravel, concrete, or other rougher surfaces, can cause the defined edge of the receptacle bottom to become marred, wear away, and/or develop a hole in the receptacle. It is desirable to overcome the drawbacks associated with conventional receptacles and associated components.

To that end, systems, methods, and devices that can facilitate producing an attachable, replaceable skid pad (e.g., skid plate) and using it on a receptacle (e.g., waste receptacle or container) are presented. In an aspect, a skid pad can be created using a desired material(s) (e.g., polymer-based material, metal, fiberglass, wood, etc.), wherein the skid pad can be desirably shaped or contoured to conform with a bottom edge portion of a receptacle (e.g., portion of a side and portion of the bottom of the receptacle that meet or are otherwise attached or connected with each other at an edge of the receptacle) so that the skid pad can be desirably attached to the bottom edge of the receptacle and so that the outer surface of the skid pad can be desirably used to move, pull, or drag the receptacle across a wide variety of surfaces, including soft or malleable surfaces (e.g., gravel, lawns, concrete, polymer surface, mud, etc.). In another aspect, the skid pad can be attached to the receptacle using a desired fastener component (e.g., screws, fastening pins) to attach it to, using a desired adhesive fastener to attach it to, or by being snapped onto, a bottom edge portion or bottom region of the receptacle. In still another aspect, the skid pad can be removable from the receptacle when desired (e.g., when the skid pad is worn) and can be replaced with another skid pad.

Referring to the drawings, FIG. 1 is a diagram of an example skid pad 100 that can facilitate movement of a receptacle across surfaces in accordance with an embodiment of the disclosed subject matter. FIG. 1 depicts the skid pad 100 from an inside view (e.g., facing the side of the skid pad 100 that can be placed on or attached to the outside surface of a bottom edge portion of a receptacle) and a cross-section view. In an aspect, the skid pad 100 (e.g., skid plate) can be constructed or fabricated from one or more materials, such as, for example, one or more of a polymer-based material (e.g., plastic, rubber, etc.), metal (e.g., steel, aluminum, copper, etc.), fiberglass, wood, etc. In another aspect, the skid pad 100 can be constructed or fabricated to have a desired shape so that the skid pad 100 can be attachable to a defined edge or associated portion of a bottom portion of a receptacle (not shown in FIG. 1; e.g., as shown in FIGS. 2, 3, 4, and 5) (e.g., attachable so that the skid pad covers at least an edge and desired portions of the bottom and side of the receptacle). In another aspect, the length of the skid pad 100 can be virtually any desired length (e.g., 1 inch, 2 inches, 3 inches, . . . 10 inches, 11 inches, 12 inches, . . . ) in relation to the length of the side of the receptacle to which the skid pad 100 is desired to be attached, for example, so that the skid pad 100 can cover all or a desired portion of the defined edge and/or desired portion of the bottom region and/or side region of the receptacle. In another aspect, the skid pad 100 can have a desired thickness (e.g., ⅛ inch, 3/16 inch, ¼ inch, or thicker), and can have a uniform thickness throughout or can have portions of the skid pad 100 that vary in thickness as compared to other portions of the skid pad 100, as desired. The amount of thickness and material used in forming the skid pad 100 can be determinative of the length of time the skid pad 100 can be usable before it is desirable to replace the skid pad 100 with another skid pad, as typically the thicker the skid pad 100 is and/or the more resistant the skid pad 100 is to wearing when dragged across a surface, the longer the skid pad 100 can be usable before becoming undesirably worn, as compared to a thinner skid pad or a skid pad formed of a material that is less resistant to wear.

In still another aspect, the skid pad 100 can be contoured so that its shape conforms, or at least substantially conforms, to the bottom edge of the receptacle to which the skid pad 100 is desired to be attached. For example, the skid pad 100 can be contoured (e.g., curved) so that the shape of the inside facing surface 102 of the skid pad 100 corresponds with the shape of the outside surface of the bottom edge region of the receptacle so that the skid pad 100 can desirably be attached to the bottom edge portion of the receptacle (e.g., the inside facing surface 102 of the skid pad 100 can be placed against the outside surface of the bottom edge region of the receptacle when the skid pad 100 is attached to the receptacle). In an aspect, as desired, even if a bottom edge of the receptacle is a relatively fine edge (e.g., not rounded) such that the bottom of the receptacle and side of the receptacle are at a specified angle (e.g., 90 degrees, 85 degrees, 80 degrees, . . . ) with respect to each other, the outside facing surface 104 of the skid pad 100 can be desirably rounded so that, when attached to the receptacle, the skid pad 100 can facilitate enabling the receptacle to be more easily moved across a surface. That is, while the inside facing surface 102 of the skid pad 100 can be contoured to conform or at least substantially conform to the shape of the bottom edge portion of the receptacle, the outside facing surface 104 of the skid pad 100 can be independently shaped as desired (e.g., to correspond with the shape of the inside facing surface 102 or differently shaped).

In still another aspect, the skid pad 100 can comprise a desired number of attachment facilitator components 106 that can be formed on the skid pad 100 to facilitate attaching the skid pad 100 to the receptacle. An attachment facilitator component 106 can be shaped such that it protrudes or extends outward a desired amount or length from the inside facing surface 102, wherein the attachment facilitator component 106 can be formed or shaped to be insertable in a corresponding recessed portion of the bottom edge region of the receptacle, wherein the contours of the attachment facilitator component 106 can correspond or at least substantially correspond to the shape of the recessed portion of the bottom edge portion of the receptacle so that the attachment facilitator component 106 can be desirably inserted in the recessed portion of the receptacle to facilitate attaching the skid pad 100 to the receptacle. In an embodiment, an attachment facilitator component 106 can be formed such that it can have a hole 108 formed therein at the top portion of the attachment facilitator component 106 so that a fastener component (e.g., screw, fastening pin, etc.) (not shown in FIG. 1) can be inserted into the hole 108 and attached to or connected with the recessed portion of the receptacle to fasten the skid pad 100 to the receptacle.

In accordance with another embodiment, the skid pad 100 can be attachable to a receptacle using a desired adhesive (e.g., an adhesive applied to the inside facing surface 102 of the skid pad 100 or to the bottom edge portion of the receptacle to which the inside facing surface 102 is desired to be attached) (not shown in FIG. 1). In accordance with still another embodiment, the attachment facilitator component 106 and the recessed portion of the receptacle can be respectively shaped so that the attachment facilitator component 106 can be inserted and attachably snapped into the recessed portion of the receptacle so that the attachment facilitator component 106 is desirably held in the recessed portion of the receptacle so that the skid pad 100 can be attached to the receptacle (not shown in FIG. 1).

In an aspect, as desired, the skid pad 100 can be removable from the receptacle and replaceable with a new skid pad, for instance, if the skid pad 100 is worn away by a particular amount. For instance, when desired, the skid pad 100 can be removed from the bottom edge portion of the receptacle by disengaging the fastener components associated with the attachment facilitator component(s) 106. In accordance with other embodiments, when an adhesive is used to attach the skid pad 100 to the receptacle, in order to detach the skid pad 100 from the receptacle, the skid pad 100 can be peeled away from the bottom edge portion of the receptacle; or, when the skid pad 100 is snapped onto the receptacle, the skid pad 100 can be removed from the bottom edge portion of the receptacle by pulling off the skid pad 100 to disengage the attachment facilitator component(s) 106 from the recessed portion(s) of the receptacle to remove the skid pad 100 from being attached to the receptacle. As desired, a new skid pad can be attached to the receptacle to replace the skid pad 100.

The subject specification, by employing an attachable, replaceable skid pad to a receptacle, can enable the receptacle to be moved with desirable ease over a wide variety of surfaces, including soft or malleable surfaces, as compared to conventional receptacle devices. As a further result, the subject specification, by employing an attachable, replaceable skid pad, can provide improved maintenance of the integrity of a receptacle when using the receptacle, for example, over a wide variety of surfaces, as compared to conventional receptacle devices, as the skid pad can prevent or minimize wear and scratching to the portions of the bottom end and side of the receptacle that can be covered by the skid pad when attached to the bottom edge portion of the receptacle.

Figure 2:
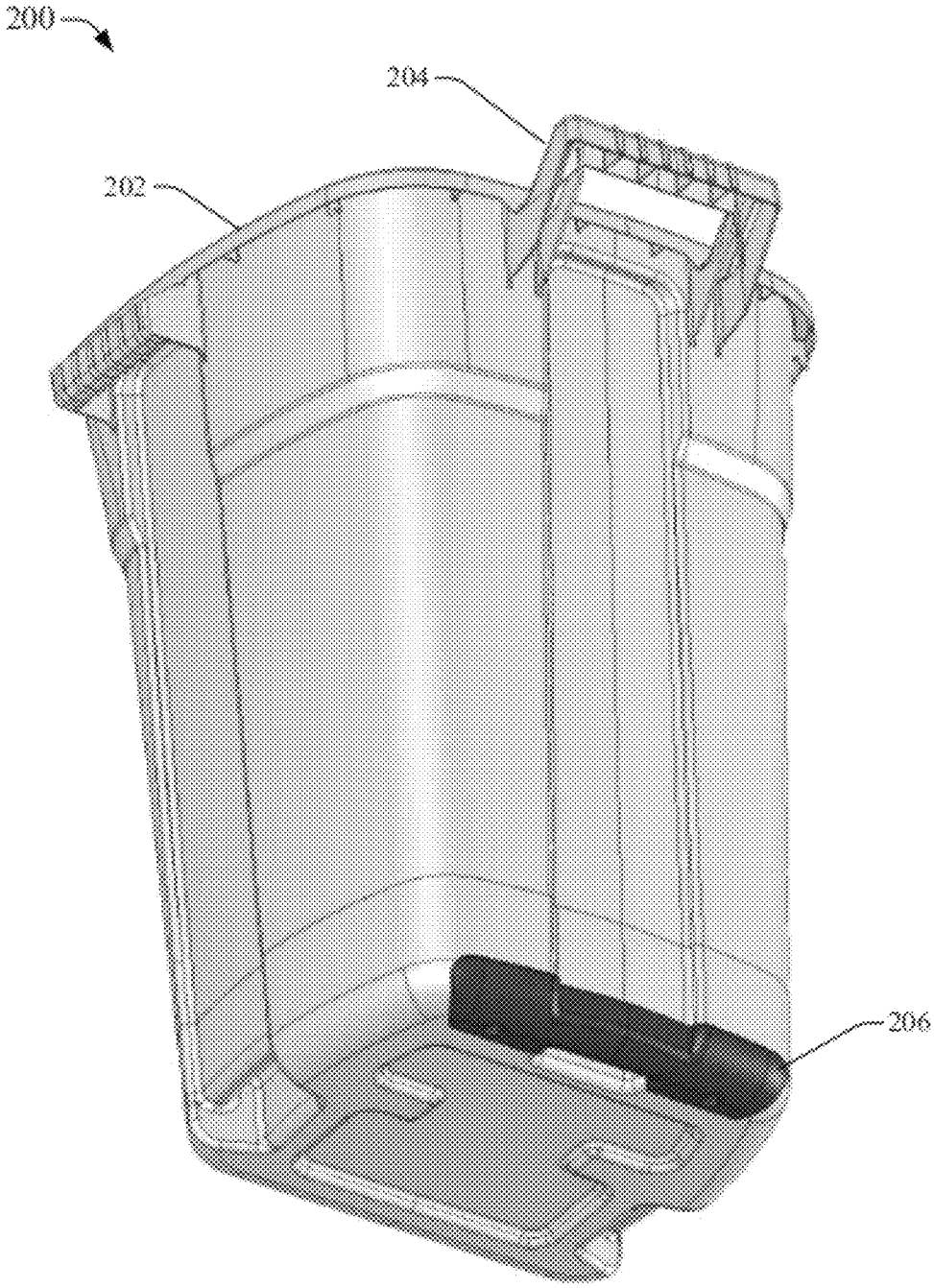
FIG. 2 illustrates a diagram of an example system that can employ an attachable, replaceable skid pad for use with a receptacle to facilitate desired use of the receptacle in accordance with various aspects and embodiments of the disclosed subject matter.

FIG. 2 illustrates a diagram of an example system 200 that can employ an attachable, replaceable skid pad for use with a receptacle to facilitate desired use of the receptacle in accordance with various aspects and embodiments of the disclosed subject matter. In an aspect, the system 200 can include a receptacle 202 (e.g., waste receptacle) that can be used to hold desired materials (e.g., solid or liquid materials, such as waste products). The receptacle 202 can be formed so that it contains one or more chambers (e.g., cavity, compartment) (not shown in this view of FIG. 2) in which the desired materials can be placed via the open or top end of the receptacle 202 and held. The receptacle 202 also can have virtually any desired shape (e.g., substantially square or rectangular base, base substantially in the shape of a trapezoid, oval or rounded base, etc.) and dimensions. The receptacle 202 can be formed of one or more desired materials, such as, for example, one or more of a polymer-based material (e.g., plastic, rubber, etc.), metal (e.g., steel, aluminum, copper, etc.), fiberglass, wood, etc.

In an aspect, the receptacle 202 can have formed thereon or attached thereto one or more handles, such as handle 204, that can be usable by a user to lift the receptacle 202, pull or drag the receptacle 202, tilt or lay down the receptacle 202, or otherwise move the receptacle 202 as desired by the user. The handle(s) 204 can be located at or near the top end (e.g., open end) of the receptacle 202 to facilitate desired maneuvering of the receptacle 202.

In still another aspect, the system 200 can include a skid pad 206 that can be attached or fastened to a bottom edge portion of the receptacle 202, for example, on the bottom edge portion of the receptacle 202 that is on the same side as a handle 204. The skid pad 206 can be constructed or fabricated from one or more desired materials, such as, for example, one or more of a polymer-based material (e.g., plastic, rubber, etc.), metal (e.g., steel, aluminum, copper, etc.), fiberglass, wood, etc. The skid pad 206 also can be removable and replaceable when desired (e.g., the skid pad 206 can be removed and disposed of when it is worn, and replaced with a new skid pad).

In another aspect, the skid pad 206 can be constructed or fabricated to have a desired shape and size so that the skid pad 206 can be attachable to the bottom edge portion of the receptacle 202. In an aspect, the skid pad 206 can be contoured so that its shape conforms, or at least substantially conforms, to the bottom edge portion of the receptacle 202 to which the skid pad 206 is desired to be attached. For example, the skid pad 206 can be formed so that the shape of the inside facing surface of the skid pad 206 corresponds with the shape of the outside surface of the bottom edge portion of the receptacle 202 so that the skid pad 206 can be desirably attached to the bottom edge portion of the receptacle 202. In another aspect, as desired, even if a bottom edge portion of the receptacle 202 is a relatively fine edge (e.g., not rounded) such that the bottom of the receptacle 202 and side of the receptacle 202 are at a specified angle (e.g., at or close to 90 degree angle in relation to each other) with respect to each other, the outside facing surface of the skid pad 206 can be desirably rounded so that, when attached to the receptacle 202, the skid pad 206 can facilitate enabling the receptacle to be more easily moved across a surface. That is, while the inside facing surface of the skid pad 206 can be contoured to conform or at least substantially conform to the shape of the bottom edge portion of the receptacle 202, the outside facing surface of the skid pad 206 can be independently shaped as desired (e.g., to correspond with the shape of the inside facing surface of the skid pad 206 or differently shaped).

Figure 3:
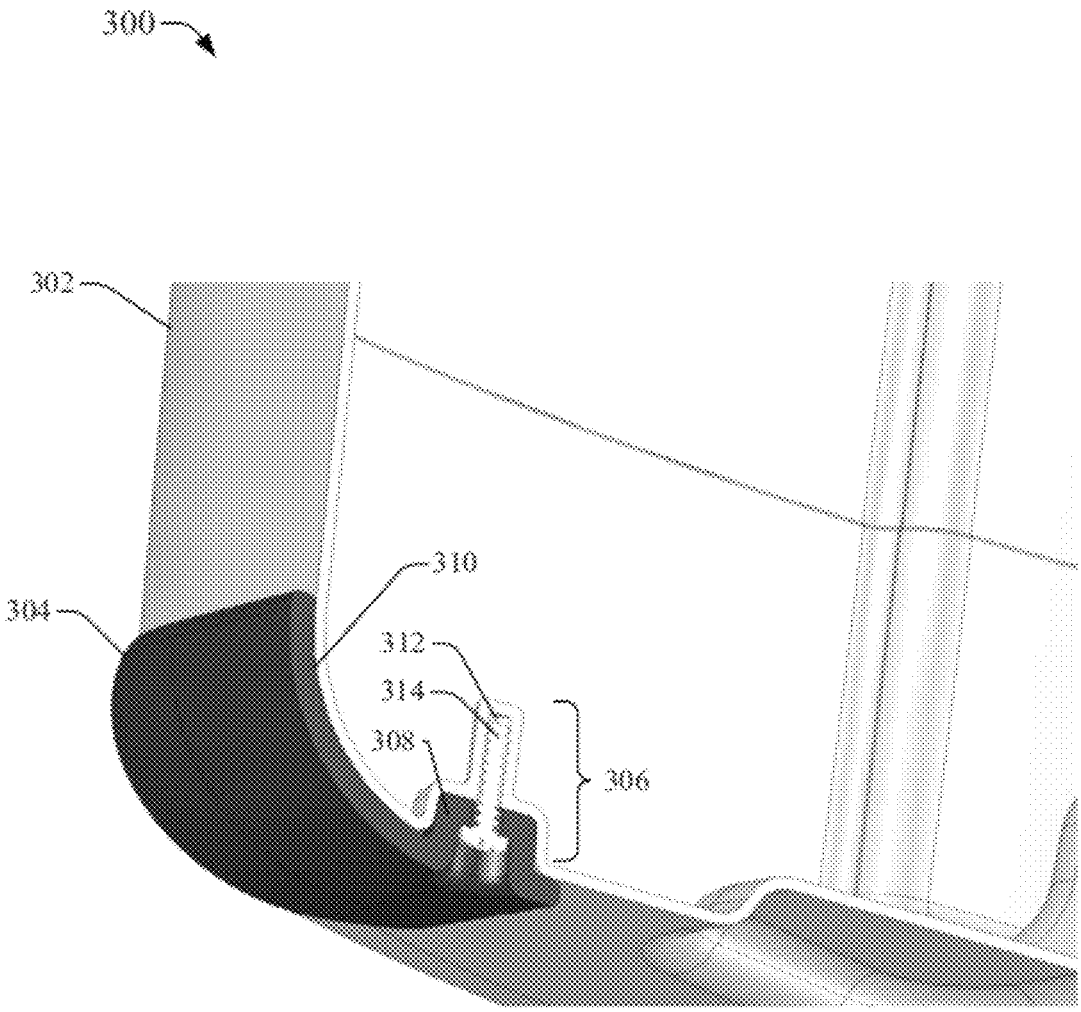
FIG. 3 depicts a cut-away diagram of an example system that can employ an attachable, replaceable skid pad for use with a receptacle to facilitate desired maneuvering of the receptacle across desired surfaces in accordance with another embodiment of the disclosed subject matter.

FIG. 3 depicts a cut-away diagram of an example system 300 that can employ an attachable, replaceable skid pad for use with a receptacle to facilitate desired maneuvering of the receptacle across desired surfaces in accordance with another embodiment of the disclosed subject matter. In an aspect, the system 300 can comprise a receptacle 302, wherein a cut-away portion of the bottom edge region is depicted in FIG. 3 to facilitate showing various aspects of the system 300. The system 300 also can include a skid pad 304, wherein a cut-away portion of the skid pad is depicted in FIG. 3.

In accordance with an aspect, the receptacle 302 can comprise a desired number of recessed regions, such as recessed region 306, that can be located on the bottom of the receptacle 302 at or near the edge of the bottom edge region of the receptacle 302 to which the skid pad 304 can be attached. For example, the receptacle 302 can include two recessed regions 306, wherein one recessed region 306 can be desirably spaced apart from another recessed region 306 on the bottom end of the receptacle 302, to facilitate attachment of the skid pad 304 to the receptacle 302.

In another aspect, the skid pad 304 can comprise a desired number of attachment facilitator components, such as attachment facilitator component 308 (wherein a cut-away portion of the attachment facilitator component 308 is depicted in FIG. 3 for clarity in order to facilitate showing various aspects of the system 300), that each can be shaped such that the attachment facilitator component 308 protrudes or extends outward a desired amount or length from the inside facing surface 310, wherein the attachment facilitator component 308 can be formed, shaped, and sized to be insertable in a corresponding recessed region 306 of the bottom edge region of the receptacle 302, wherein the shape and size of the attachment facilitator component 308 can correspond or at least substantially correspond to the shape and size of the recessed region 306 of the bottom edge portion of the receptacle 302 so that the attachment facilitator component 308 can be desirably inserted in the recessed region 306 of the receptacle 302 to facilitate attaching the skid pad 304 to the receptacle 302.

In an embodiment, an attachment facilitator component 308 can be formed such that it can have a hole 312 formed therein at the top portion of the attachment facilitator component 308 so that a fastener component 314 (e.g., screw, fastening pin, etc.) can be inserted into the hole 312 and attached to or connected with the recessed region 306 of the receptacle 302 to fasten the skid pad 304 to the receptacle 302.

In an aspect, the inner facing surface 310 of the skid pad 304 can be contoured (e.g., curved) so that the shape of the inside facing surface 310 of the skid pad 304 can correspond with the shape of the outside surface of the bottom edge region of the receptacle 302 so that the skid pad 304 can desirably be attached to the bottom edge portion of the receptacle 302 (e.g., the inside facing surface 310 of the skid pad 304 can be placed against the outside surface of the bottom edge region of the receptacle 302 when the skid pad 304 is attached to the receptacle 302).

Figure 4:
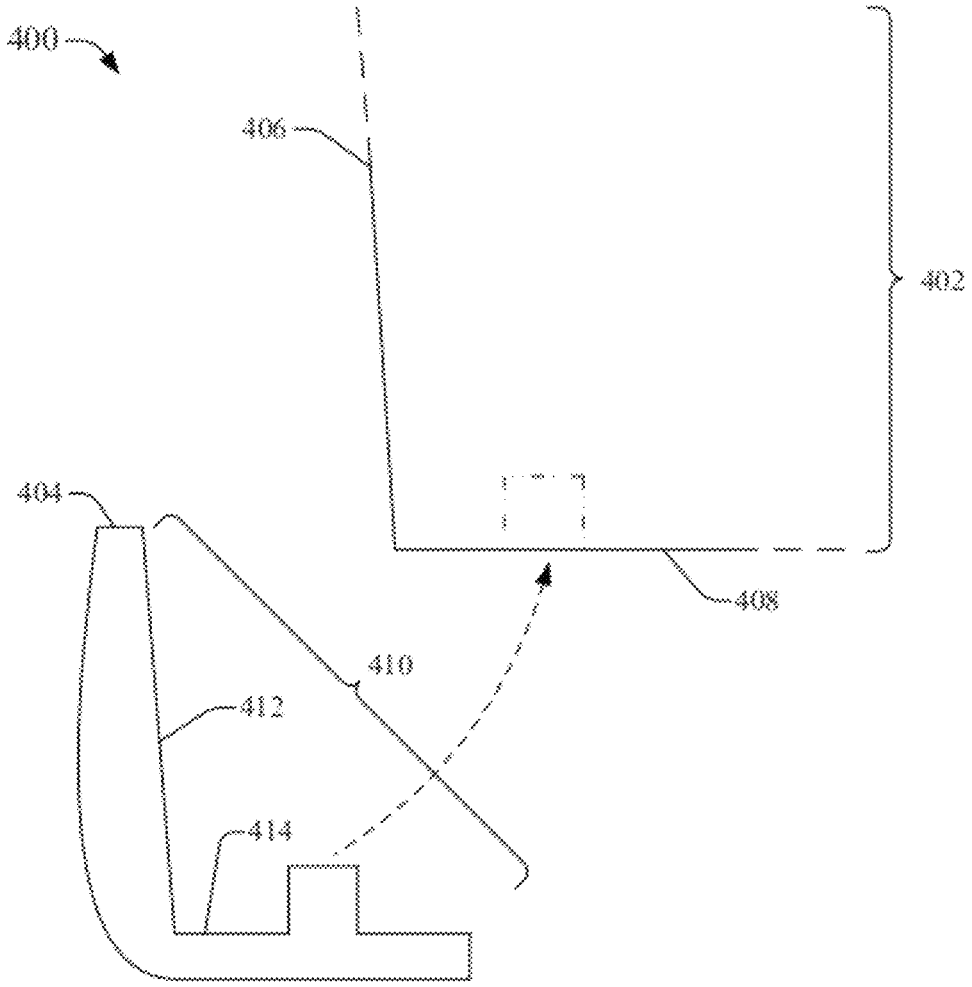
FIG. 4 depicts a cut-away diagram of an example system that can employ an attachable, replaceable skid pad for use with a receptacle to facilitate desired maneuvering of the receptacle across desired surfaces in accordance with still another embodiment of the disclosed subject matter.

Referring to FIG. 4, depicted is a cut-away diagram of an example system 400 that can employ an attachable, replaceable skid pad for use with a receptacle to facilitate desired maneuvering of the receptacle across desired surfaces in accordance with still another embodiment of the disclosed subject matter. In an aspect, the system 400 can comprise a receptacle 402, wherein a cut-away portion of the bottom edge region is depicted in FIG. 4 to facilitate showing various aspects of the system 400. The system 400 also can include a skid pad 404, wherein a cut-away portion of the skid pad is depicted in FIG. 4. In another aspect, the receptacle 402 can be shaped so that the side 406 of the receptacle 402 can be substantially perpendicular (as depicted) (or perpendicular, or at another desired angle in relation) to the bottom end 408 of the receptacle 402.

In still another aspect, the inner facing surface 410 of the skid pad 404 can be contoured (e.g., shaped) so that the shape of the inside facing surface 410 of the skid pad 404 can correspond with the shape of the outside surface of the bottom edge region of the receptacle 402, that is, the shape of the portion of the receptacle comprising the side 406 and bottom end 408 of the receptacle 402, so that the skid pad 404 can desirably be attached to the bottom edge portion of the receptacle 402 (e.g., the inside facing surface 410 of the skid pad 404 can be placed against the outside surface of the bottom edge region of the receptacle 402 when the skid pad 404 is attached to the receptacle 402. For example, the inner facing surface 410 can be contoured so that a first portion 412 of the inner facing surface 410 can be substantially perpendicular (as depicted) (or perpendicular, or at another desired angle in relation) to a second portion 414 of the inner facing surface 410 in an manner that corresponds to the shape of the outside surface of the bottom edge region of the receptacle 402 to which the skid pad 404 is to be attached.

Figure 5:
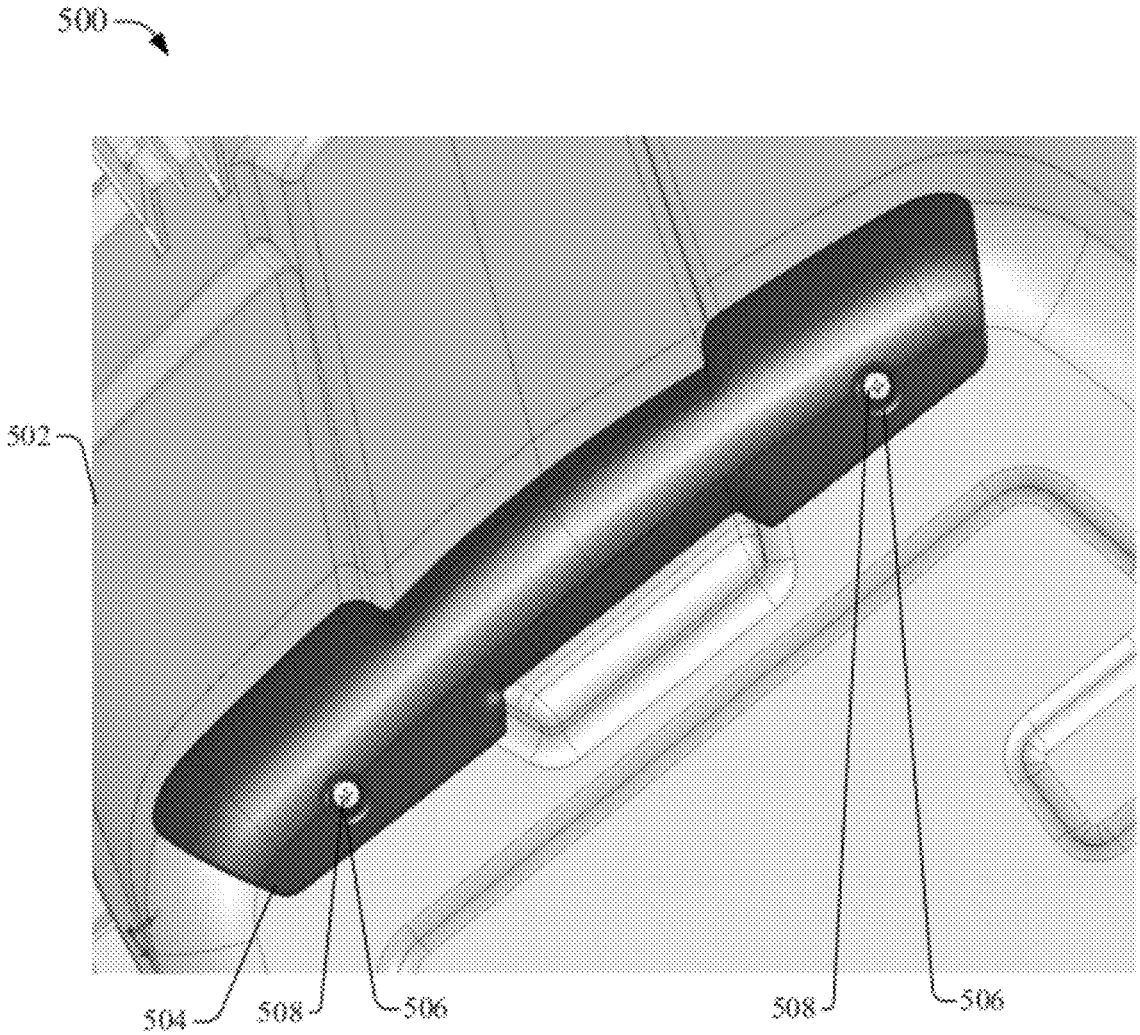
FIG. 5 illustrates is a cut-away diagram of an example system that can employ an attachable, replaceable skid pad for use with a receptacle to facilitate desired movement of the receptacle across desired surfaces in accordance with various aspects of the disclosed subject matter.

FIG. 5 illustrates is a cut-away diagram of an example system 500 that can employ an attachable, replaceable skid pad for use with a receptacle to facilitate desired movement of the receptacle across desired surfaces in accordance with various aspects of the disclosed subject matter. FIG. 5 illustrates a receptacle 502 with a skid pad 504 fastened thereto as viewed from an angle that shows a portion of the side and bottom of the receptacle 502 that includes the bottom edge region of the receptacle 502 to which the skid pad is fastened. In an aspect, the skid pad 504 can comprise attachment facilitator components 506 that can be located a desired distance from each other on the bottom portion of the skid pad 504. The attachment facilitator components 506 can have respective holes therein to facilitate fastening the skid pad 504 to the receptacle 502. In an aspect, the system 500 can comprise a desired number of fastener components 508 (e.g., screws, pins, etc.) that can be inserted in the respective holes of the attachment facilitator components 506 and further inserted into corresponding holes (not shown in FIG. 5) on the bottom end of the receptacle 502 to facilitate attachment of the skid pad 504 to the receptacle 502. In another aspect, the attachment facilitator components 506 can be formed to include recessed areas in the skid pad 504 so that when the fastener components 508 are inserted into the attachment facilitator components 506 to the desired point, the fastener components 508 can be recessed within the skid pad 504 so that the top ends of the fastener components 508 are flush with the surface of the skid pad 504 or are recessed within the recessed areas of the attachment facilitator components 506.

In accordance with various embodiments, as desired, on the inside facing surface (not shown in FIG. 5) of the skid pad 504, the attachment facilitator components 506 can be formed to protrude or extend out from the inside facing surface to be insertable in corresponding recessed areas (not shown) of the receptacle 502, or the attachment facilitator components 506 can be flat or flush with the inside facing surface of the skid pad 504, wherein the bottom end of the receptacle 502 does not require recessed areas to accommodate the corresponding attachment facilitator components 506.

Figure 6:
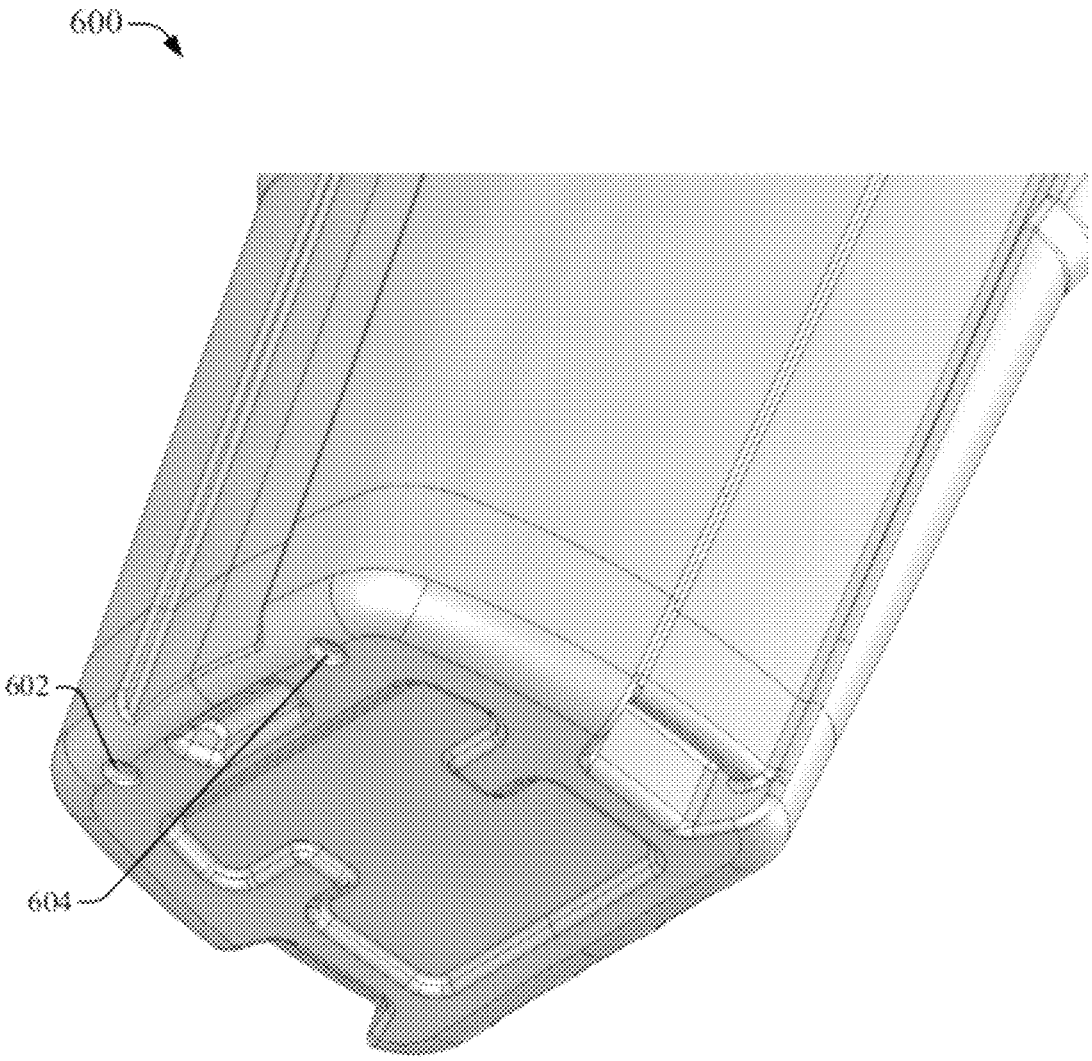
FIG. 6 depicts a diagram of a portion of an example receptacle that can be employed with a skid pad in accordance with an embodiment of the disclosed subject matter.

FIG. 6 depicts a diagram of a portion of an example receptacle 600 that can be employed with a skid pad in accordance with an embodiment of the disclosed subject matter. FIG. 6 shows the outside surface of the bottom end, a portion of the side region, and a portion of the back region of the receptacle 600. In an aspect, the receptacle 600 can comprise a desired number of recessed regions, such as recessed region 602 and recessed region 604, that can be formed in the bottom end of the receptacle 600. As desired, the recessed regions (e.g., 602, 604) can be threaded (not shown in FIG. 6) to correspond with the threading of a fastener component (e.g., screw) (not shown in FIG. 6) or otherwise formed to accommodate and be usable with a fastener component, as, for example, the recessed regions can be unthreaded (at least initially) but can still accommodate fastener components, such as screws, wherein the fastener components can thread the recessed regions when the fastener components are inserted into the recessed regions. As another example, when a skid pad is attachable by snapping the attachment facilitator component into the recessed region (e.g., 602, 604) of the receptacle 600, the recessed region can be shaped to facilitate enabling the attachment facilitator component to be inserted and snapped into the recessed region, and held by the recessed region after being snapped therein). In an aspect, the recessed regions (e.g., 602, 604) can be located on the bottom end of the receptacle 600 to correspond to the attachment facilitator components of the skid pad so that the skid pad can be desirably attached to the bottom edge portion of the receptacle 600. Also, the recessed region 602 and recessed region 604 can be formed a desired distance apart from each other.

Figure 7:
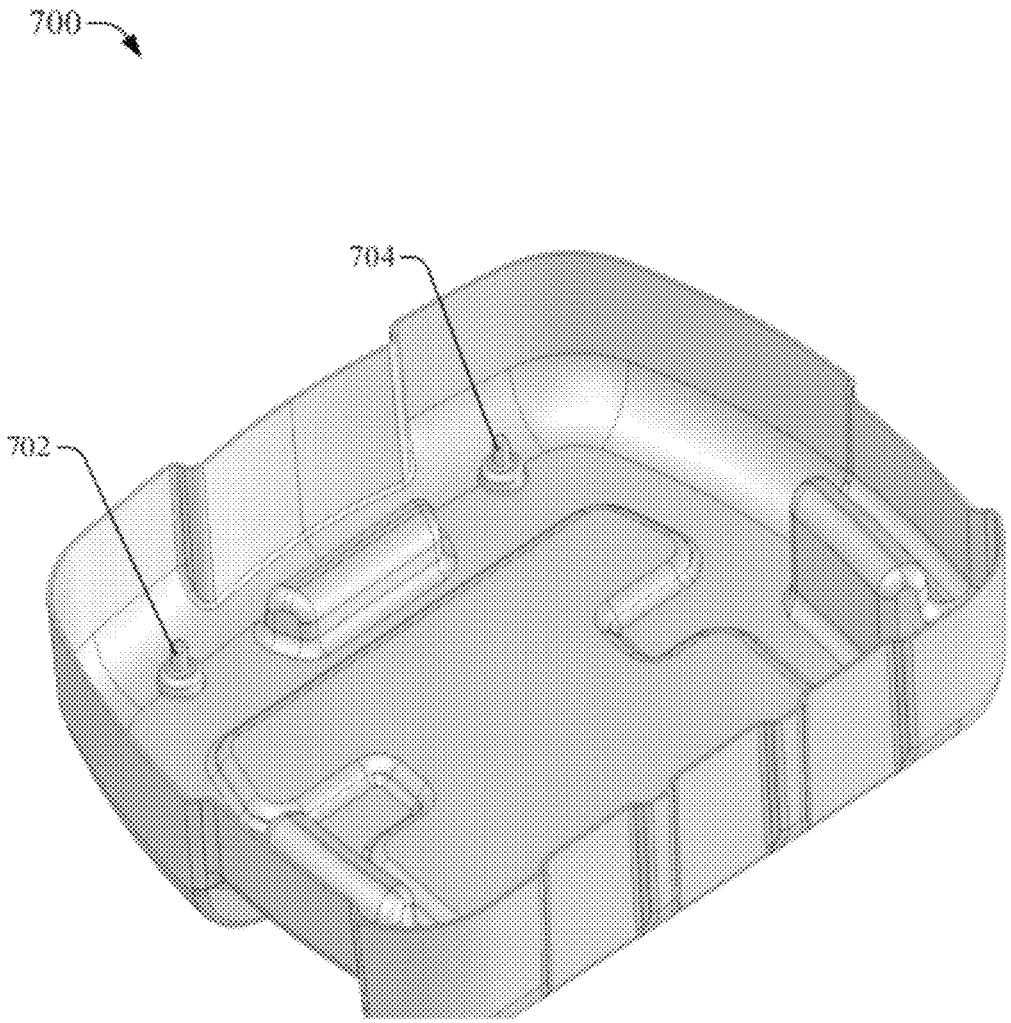
FIG. 7 illustrates a cut-away diagram of a portion of an example receptacle that can be employed with a skid pad in accordance with an embodiment of the disclosed subject matter.

FIG. 7 illustrates a cut-away diagram of a portion of an example receptacle 700 that can be employed with a skid pad in accordance with an embodiment of the disclosed subject matter. FIG. 7 shows the receptacle 700 with a portion of the receptacle shown cut away to show the inside surface of the bottom portion of the receptacle 700. In an aspect, the receptacle 700 can comprise a desired number of recessed regions, such as recessed region 702 and recessed region 704, that can be formed in the bottom end of the receptacle 700 to facilitate attaching a skid pad (not shown in FIG. 7) to the bottom edge portion of the receptacle 700 (e.g., outside surface of the bottom edge portion of the receptacle 700). In accordance with various embodiments, the recessed regions 702 and 704 can be formed or molded of the same material (e.g., plastic) as other portions (e.g., sides) of the receptacle 700 and/or can be formed of, or can include, different material(s) (e.g., metal) from the other portions of the receptacle 700, as desired.

Figure 8:
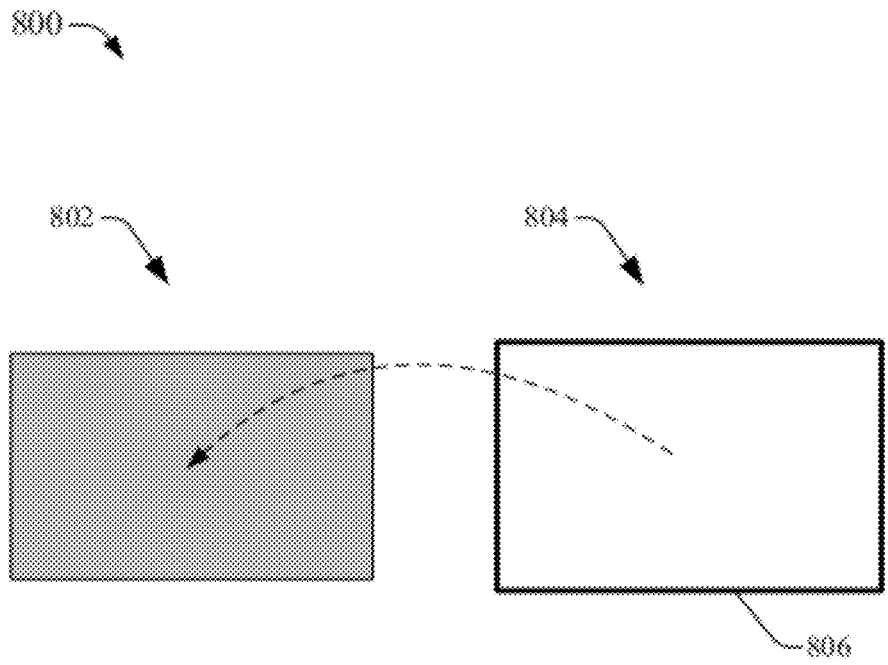
FIG. 8 depicts a bottom-view diagram of an example system that can employ a skid pad that can be attachable to and usable with a receptacle in accordance with an embodiment of the disclosed subject matter.

FIG. 8 depicts a bottom-view diagram of an example system 800 that can employ a skid pad that can be attachable to and usable with a receptacle in accordance with an embodiment of the disclosed subject matter. In an aspect, the system 800 can include a receptacle 802 (bottom end of the receptacle 802 is depicted in FIG. 8) and a skid pad 804 that can be attachable to the bottom end of the receptacle 802 and replaceable at a desired time (e.g., when the skid pad 804 is worn). In this embodiment, the skid pad 804 can be sized and shaped in relation to the bottom end of the receptacle 802 so that the skid pad 804 covers all or a substantial portion of the bottom end of the receptacle 802 when attached to the receptacle 802. In an aspect, at least one end 806 of the skid pad 804 can be contoured to extend over and cover at least part of the side of the receptacle 802 to which the skid pad 804 is attached (not shown in FIG. 8; e.g., as shown in FIGS. 2, 3, and 4).

Figure 9:
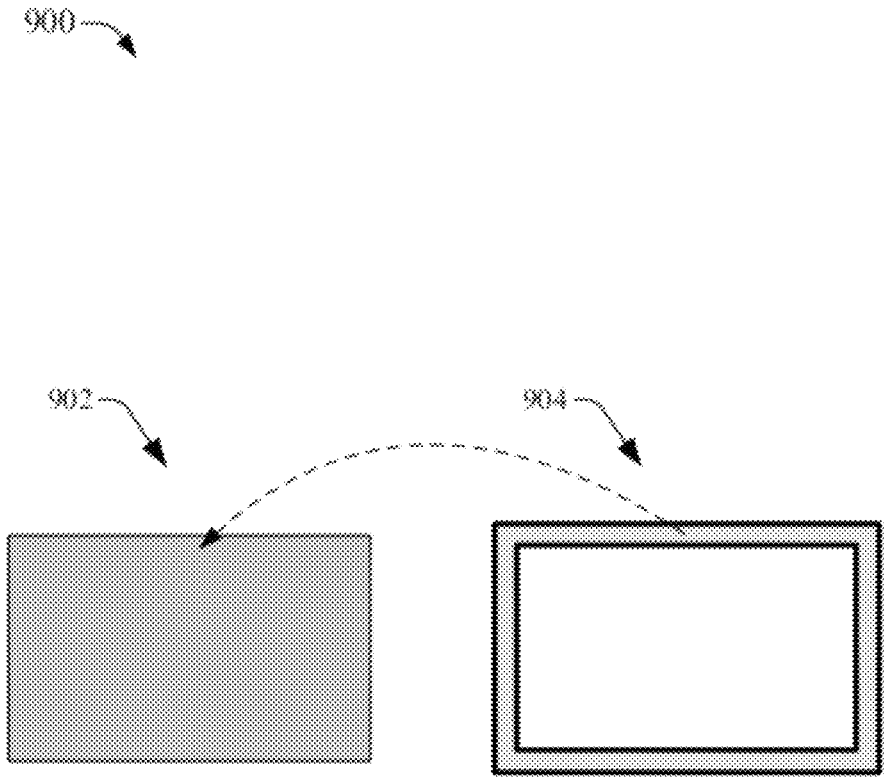
FIG. 9 illustrates a bottom-view diagram of an example system that can employ a skid pad that can be attachable to and usable with a receptacle in accordance with another embodiment of the disclosed subject matter.

FIG. 9 illustrates a bottom-view diagram of an example system 900 that can employ a skid pad that can be attachable to and usable with a receptacle in accordance with another embodiment of the disclosed subject matter. In an aspect, the system 900 can include a receptacle 902 (bottom end of the receptacle 902 is depicted in FIG. 9) and a skid pad 904 that can be attachable to the bottom end of the receptacle 902 and replaceable at a desired time (e.g., when the skid pad 904 is worn). In this embodiment, the skid pad 904 can be sized and shaped in relation to the bottom end of the receptacle 902 so that the skid pad 904 each of the edge portions of the bottom end of the receptacle 902 when attached to the receptacle 902. In an aspect, the skid pad 904 can be contoured to cover at least part of each of the sides of the receptacle 902 to which the skid pad 904 is attached (not shown in FIG. 9; e.g., as shown in FIGS. 2, 3, and 4). It is to be appreciated and understood that, in accordance with other embodiments, as desired, one or more skid pads (e.g., skid pad as shown in FIG. 1, 2, 3, or 4, etc.) can be attached to one or more respective bottom edge portions associated with respective sides of a receptacle to facilitate movement of the receptacle across desired surfaces, for example, by pulling or dragging the receptacle on a desired skid pad of the skid pads attached to the receptacle.

It is to be further appreciated and understood that, in accordance with various other embodiments, the skid pad can be shaped and sized to be virtually any desired shape and size in relation to the bottom end of the receptacle and associated side(s) of the receptacle, and all such embodiments of the skid pad are within the scope of the subject specification, the claims, and their legal equivalents. For example, a skid pad can be shaped and sized to span across the bottom end of the receptacle, and to partially cover a desired number of sides (e.g., 1 side; 2 sides; 4 sides; any side that has a handle associated therewith; etc.), but can have one or more portions of the skid pad cut out on the bottom end which can thereby expose portions of the bottom end of the receptacle (e.g., FIG. 9 depicts a skid pad 904 that spans across the bottom end of the receptacle 902, and partially covers 4 sides of the 4-sided receptacle 902; a skid pad can span across the bottom end of a receptacle, and partially covers 2 sides of a 4-sided receptacle, wherein those 2 sides each have a handle attached thereto, and wherein the skid pad has 3 cut out rectangular regions to thereby result in 2 middle inner skid branches and/or 2 outer skid branches in addition to and in between the portions of the skid pad that are associated with the 2 sides that have handles; a skid pad can span across the bottom end of a receptacle, and partially covers all 4 sides of a 4-sided receptacle, wherein the skid pad has 3 cut out rectangular regions to thereby result in 2 middle inner skid branches in addition to the portions of the skid pad that are associated with the 4 edges and sides associated with the bottom of the receptacle; etc.).

The aforementioned systems and/or devices have been described with respect to interaction between several components. It should be appreciated that such systems and components can include those components or sub-components specified therein, some of the specified components or sub-components, and/or additional components. Sub-components could also be implemented as components communicatively coupled to other components rather than included within parent components. Further yet, one or more components and/or sub-components may be combined into a single component providing aggregate functionality. The components may also interact with one or more other components not specifically described herein for the sake of brevity, but known by those of skill in the art.

Figure 10:
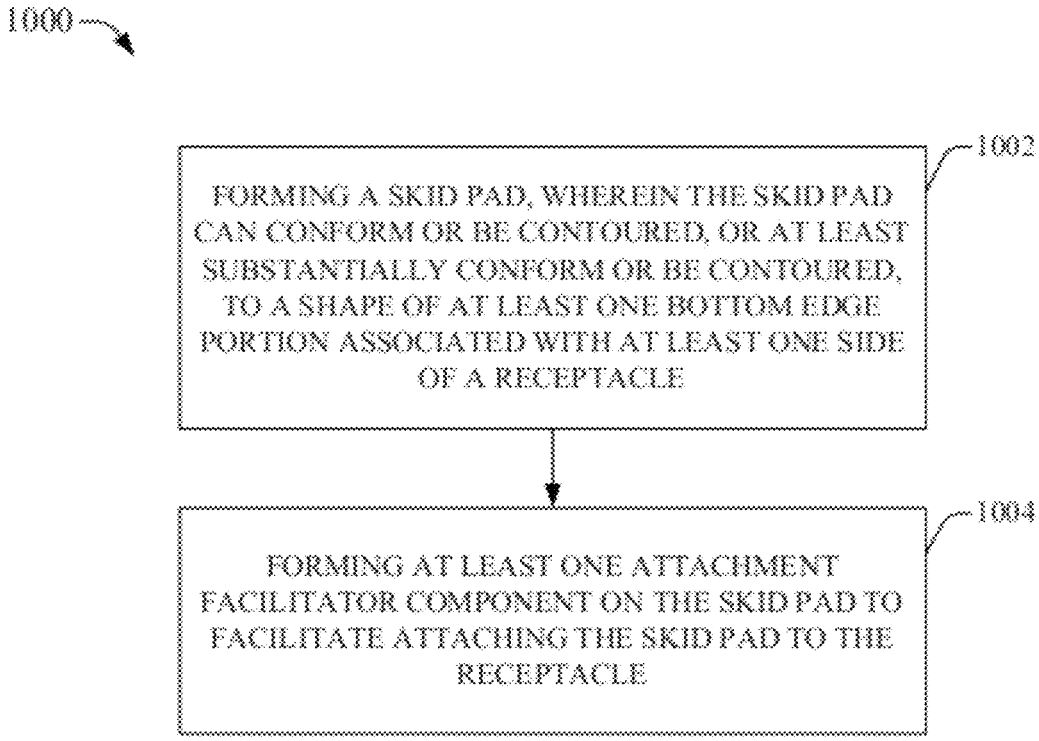
FIG. 10 illustrates a flowchart of an example method that can facilitate constructing or forming a skid pad in accordance with various aspects and embodiments of the disclosed subject matter.
Figure 11:
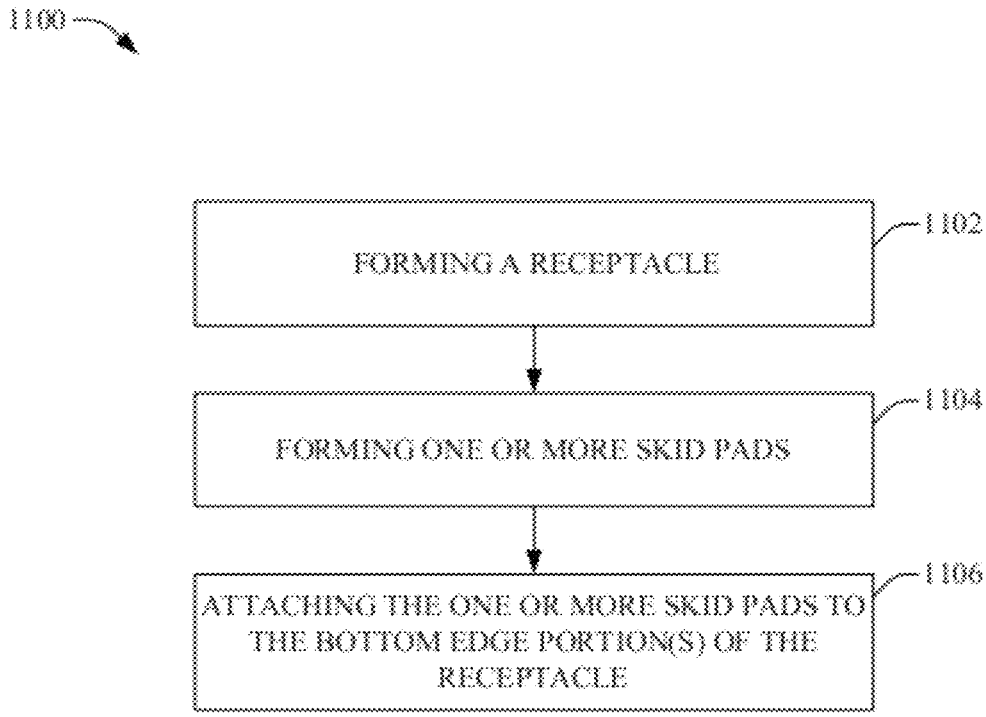
FIG. 11 depicts a flowchart of an example method that can facilitate constructing a receptacle comprising a skid pad in accordance with an aspect of the disclosed subject matter.

In view of the example components, devices, and systems described herein, example methodologies that can be implemented in accordance with the disclosed subject matter can be better appreciated with reference to flowcharts in FIGS. 10-11. For purposes of simplicity of explanation, example methodologies disclosed herein are presented and described as a series of acts; however, it is to be understood and appreciated that the disclosed subject matter is not limited by the order of acts, as some acts may occur in different orders and/or concurrently with other acts from that shown and described herein. For example, a method disclosed herein could alternatively be represented as a series of interrelated states or events, such as in a state diagram. Moreover, interaction diagram(s) may represent methodologies in accordance with the disclosed subject matter when disparate entities enact disparate portions of the methodologies. Furthermore, not all illustrated acts may be required to implement a method in accordance with the subject specification.

FIG. 10 presents a flowchart of an example method 1000 that can facilitate constructing or forming a skid pad in accordance with various aspects and embodiments of the disclosed subject matter. At 1002, a skid pad can be formed, wherein the skid pad can conform or be contoured, or at least substantially conform or be contoured, to a shape of at least one bottom edge portion associated with at least one side of a receptacle. At 1004, at least one attachment facilitator component can be formed on the skid pad to facilitate attaching the skid pad to the receptacle. For example, a desired number of attachment facilitator components can be formed on the skid pad to correspond with a desired number of attachable regions (e.g., holes and/or recessed regions) on the bottom end or side end of the receptacle in the area of the bottom edge portion(s) of the receptacle to facilitate attaching the skid pad to the receptacle.

FIG. 11 depicts a flowchart of an example method 1100 that can facilitate constructing a receptacle comprising a skid pad in accordance with an aspect of the disclosed subject matter. At 1102, a receptacle (e.g., waste container) can be formed. In an aspect, the receptacle can have a desired shape (e.g., squared sides, rectangular sides, 4 sides shaped in relation to each other to be substantially in the form of a trapezoid, cylindrical shape, etc.) and size (e.g., capacity to hold a desired number of cubic inches of material, capacity to hold a desired amount of material in pounds, etc.), wherein the top end of the receptacle can be partially or wholly open to allow users to insert materials into the chamber(s) (e.g., cavity, compartment) formed in the receptacle, and wherein the bottom end can be closed to facilitate holding material within the chamber(s) of the receptacle. The receptacle also can include one or more handles that can be formed on or attached to one or more sides of the receptacle to facilitate controlling the position of and moving (e.g., lifting, pulling, dragging, etc.) the receptacle, as desired. The receptacle can be formed out of a desired material(s) (e.g., plastic or other polymer material, metal, fiberglass, etc.)

At 1104, one or more skid pads can be formed. A skid pad can be formed out of a desired material (e.g., plastic or other polymer material, metal, fiberglass, etc.) and can have a desired thickness(es) (e.g., consistent thickness across the entire skid pad, or varying thicknesses across the skid pad based at least in part on the shape and size of the skid pad as well as the shape of the bottom edge portion(s) to which the skid pad is to be attached). The skid pad also can be shaped and sized, as desired, as more fully disclosed herein. For example, the skid pad can be shaped and sized to cover a bottom edge portion of the receptacle associated with one side of the receptacle, wherein the inner facing surface of the skid pad can be shaped to conform, or at least substantially conform, to the shape of the bottom edge portion, wherein the outer facing surface of the skid pad can be desirable shaped (e.g., rounded) to facilitate desirably moving the receptacle across a surface, and wherein the skid pad can be sized to cover a portion of the bottom end and a portion of the side of the receptacle to which the skid pad is to be attached. In another aspect, a skid pad can comprise one or more attachment facilitator components that can be used to attach the skid pad to the receptacle. For instance, the attachment facilitator components can be formed on the skid pad such that they correspond to holes or recessed regions formed in the bottom end of the receptacle at the bottom edge portion to which the skid pad is to be attached.

At 1106, the one or more skid pads can be attached to the bottom edge portion(s) of the receptacle. For instance, a skid pad can be attached to a bottom edge portion of the receptacle associated with a side of the receptacle that has a handle formed thereon or attached thereto.

It is to be appreciated and understood that components (e.g., receptacle, skid pad, attachment facilitator component, bottom edge portion, recessed region, attachable region, etc.), as described with regard to a particular component, device, system or methodology, can include the same or similar functionality as respective components (e.g., respectively named components) as described with regard to other components, devices, systems, or methodologies disclosed herein.

What has been described above includes examples of systems and methods that provide advantages of the subject specification. It is, of course, not possible to describe every conceivable combination of components or methodologies for purposes of describing the disclosed subject matter, but one of ordinary skill in the art may recognize that many further combinations and permutations of the disclosed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A device that facilitates movement of a receptacle, comprising:

a skid pad that is configured to be attachable to a bottom edge portion of the receptacle to facilitate the movement of the receptacle across a surface, wherein the skid pad is configured to span across the bottom edge portion associated with a first side portion of the receptacle that is associated with the bottom edge portion from a second side portion of the receptacle to a third side portion of the receptacle, wherein the second side portion and the third side portion are at respective ends of the first side portion; and one or more attachment facilitator components that are formed on the skid pad to facilitate attachment of the skid pad to the bottom edge portion of the receptacle.

2. The device of claim 1, wherein the bottom edge portion and the first side portion of the receptacle combine in relation to each other to form a defined shape, and the skid pad comprises an inside facing surface that has a shape that is contoured to conform with the defined shape of the bottom edge portion and the side portion, and an outside facing surface of the skid pad comprises a rounded shape that is at least partially rounded and is shaped independent of the shape of the inside facing surface.

3. The device of claim 2, wherein the inside facing surface of the skid pad is a surface that faces the bottom edge portion when the skid pad is attached to the bottom edge portion.

4. The device of claim 1, wherein the skid pad is shaped in the form of a ring shape that corresponds to a shape of a bottom end of the receptacle and covers at least respective portions of respective bottom edges of the bottom end of the receptacle and respective portions of respective sides of the receptacle when the skid pad is attached to the bottom end of the receptacle.

5. The device of claim 1, wherein the skid pad is shaped and sized such that an outside facing surface of the skid pad is at least partially rounded, the outside facing surface is a surface of the skid pad that is not facing the bottom edge portion of the receptacle when the skid pad is attached to the receptacle.

6. The device of claim 1, wherein the skid pad is constructed of one or more materials comprising a polymer-based material, a metal-based material, fiberglass, or wood.

7. The device of claim 1, wherein at least one attachment facilitator component of the one or more attachment facilitator components protrudes outward by a specified length from an inside facing surface of the skid pad, wherein a size and a shape of the at least one facilitator component conforms to at least one corresponding recessed region in a bottom end portion of the receptacle to facilitate insertion of at least a portion of the at least one attachment facilitator component in the at least one corresponding recessed region when the skid pad is attached to the receptacle.

8. The device of claim 1, wherein the one or more attachment facilitator components comprises an adhesive material applied on an inside facing surface of the skid pad to facilitate an attachment of the inside facing surface to the bottom edge portion of the receptacle.

9. A system that facilitates movement of a receptacle across a surface, comprising:

the receptacle, wherein the receptacle is formed to comprise a bottom end that is closed and a top end that is at least partially open to form a chamber in the receptacle to facilitate holding materials within the chamber; and a skid pad that is configured to be attachable to a bottom edge portion of the bottom end of the receptacle to facilitate the movement of the receptacle across the surface, wherein the skid pad is further configured to span across the bottom edge portion associated with a first side portion of the receptacle that is associated with the bottom edge portion from a second side portion of the receptacle to a third side portion of the receptacle, wherein the second side portion and the third side portion are at respective ends of the first side portion.

10. The system of claim 9, further comprising:

a handle that is formed on or attached to a side associated with the bottom edge portion of the receptacle.

11. The system of claim 9, wherein the skid pad is further configured to comprise:

a specified number of attachment facilitator components that are formed on the skid pad to correspond with a specified number of attachable regions formed on the receptacle to facilitate attachment of the skid pad to the receptacle.

12. The system of claim 11, further comprising:

a specified number of fastener components that are configured to be insertable into the specified number of attachment facilitator components and the specified number of attachable regions to facilitate attachment of the skid pad to the receptacle.

13. The system of claim 11, wherein at least a portion of the attachment facilitator components and at least a portion of the attachable regions are respectively configured in shape in relation to each other to facilitate snapping the specified attachment facilitator components into the attachable regions respectively corresponding to the attachment facilitator components to facilitate attachment of the skid pad to the receptacle.

14. The system of claim 9, wherein an inside facing surface of the skid pad is shaped to conform with a shape of the bottom edge portion of the receptacle, and the inside facing surface of the skid pad is a surface that faces the bottom edge portion when the skid pad is attached to the bottom edge portion.

15. The system of claim 9, wherein the skid pad is shaped and sized such that an outside facing surface of the skid pad is at least partially rounded, the outside facing surface is a surface of the skid pad that is not facing the bottom edge portion of the receptacle when the skid pad is attached to the receptacle.

16. The system of claim 9, wherein at least one of the skid pad or the receptacle is constructed of one or more materials comprising a polymer-based material, a metal-based material, fiberglass, or wood.

17. A method, comprising:

forming a skid pad that is sized and shaped to substantially span across a bottom edge portion associated with a first side portion of a receptacle from a second side portion of the receptacle to a third side portion of the receptacle wherein the second side portion and the third side portion are at respective ends of the first side portion; and forming at least one attachment facilitator component on the skid pad to facilitate attaching the skid pad to the receptacle.

18. The method of claim 17, further comprising:

forming the receptacle to comprise a bottom end that is closed and a top end that is at least partially open to form at least one chamber in the receptacle usable to hold materials; and forming at least one attachable region on the receptacle, wherein the at least one attachable region is positioned on the receptacle to correspond with the at least one attachment facilitator component when the skid pad is attached to the receptacle such that that the skid pad is attachable to the bottom edge portion of the receptacle.

19. The method of claim 18, wherein the forming at least one attachment facilitator component on the skid pad further comprises forming the at least one attachment facilitator component on the skid pad to comprise an extended portion on an inside facing side of the skid pad; and wherein the forming the at least one attachable region comprises forming the at least one attachable region to be recessed such that the at least one attachable region is shaped to conform with a shape of the extended portion on the inside facing side of the skid pad to facilitate attaching the skid pad to the receptacle.

20. The method of claim 17, further comprising:

at least one of forming or attaching at least one handle on the first side of the receptacle, wherein the first side is associated with the bottom edge portion, and wherein the forming the skid pad further comprises forming the skid pad such that the skid pad covers at least a portion of the first side and at least a portion of the bottom edge portion of a bottom end of the receptacle.

* * * * *